US007372435B2

(12) United States Patent
Kim et al.

(10) Patent No.: US 7,372,435 B2
(45) Date of Patent: May 13, 2008

(54) DRIVING METHOD OF PLASMA DISPLAY PANEL

(75) Inventors: Dai Hyun Kim, Goonpo-si (KR); Jeong Pil Choi, Suwon-si (KR); Kyu Seon Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 526 days.

(21) Appl. No.: 10/797,578

(22) Filed: Mar. 11, 2004

(65) Prior Publication Data

US 2004/0233135 A1 Nov. 25, 2004

(30) Foreign Application Priority Data

Mar. 11, 2003 (KR) ..... 10-2003-0015175

(51) Int. Cl.
*G09G 3/28* (2006.01)
*G09G 5/10* (2006.01)

(52) U.S. Cl. ..... 345/68; 345/60; 345/63; 345/204; 345/690

(58) Field of Classification Search ..... 345/60, 345/63, 68, 204, 690, 691, 692, 694
See application file for complete search history.

(56) References Cited

U.S. PATENT DOCUMENTS 5,818,419 A * 10/1998 Tajima et al. ..... 345/691
5,835,072 A * 11/1998 Kanazawa ..... 345/60
5,898,414 A * 4/1999 Awamoto et al. ..... 345/55
2002/0195435 A1 12/2002 Nagarkar et al.

FOREIGN PATENT DOCUMENTS

| | | |
|---|---|---|
| EP | 0977060 A2 | 7/1999 |
| JP | 10163671 | 11/1996 |
| WO | WO 02/05201 A1 | 1/2002 |
| WO | WO 02/45006 A2 | 6/2002 |

OTHER PUBLICATIONS

EP Search report dated Jul. 2, 2004.

* cited by examiner

*Primary Examiner*—My-Chau T. Tran
(74) *Attorney, Agent, or Firm*—Ked & Associates, LLP

(57) ABSTRACT

The present invention relates to a driving method of a plasma display panel for improving a picture quality. The driving method of a plasma display panel in which an $n^{th}$ frame having a first brightness weighting value and a $(n+1)^{th}$ frame having a brightness weighting value different from the first brightness weighting value are alternatively arranged every vertical synchronous signal to display a certain image, wherein one frame period of the $n^{th}$ frame or the $(n+1)^{th}$ frame is variably set such that a brightness expression period can be identically set at the $n^{th}$ frame and the $(n+1)^{th}$ frame.

7 Claims, 9 Drawing Sheets

DRIVING METHOD OF PLASMA DISPLAY PANEL

BACKGROUND OF THE INVENTION

1. Field of the Invention

The present invention relates to a plasma display panel, and more particularly, to a driving method of a plasma display panel for improving a picture quality.

2. Description of the Related Art

Plasma display panel (hereinafter referred to as "PDP") generally displays an image including character or graphic by generating light from fluorescent substance using ultraviolet rays with a wavelength of 147 nm, which is generated during a gas LB discharge of an inert mixture gas, such as He+Xe, Ne+Xe, He+Ne+Xe or the like. This PDP has easy slimness and large-sized characteristics, and provides a greatly improved picture quality thanks to the recent technology development. Especially, three-electrode alternating current (AC) surface discharge type PDP has advantages of a low voltage operation and a long life since wall charges stored on a surface in the course of discharge protect electrodes from sputtering generated by the discharge.

FIG. 1 is a view illustrating a discharge cell of a conventional three-electrode AC surface discharge type plasma display panel.

Referring to FIG. 1, a discharge cell of the three-electrode AC surface discharge type PDP includes a scan electrode (Y) and a sustain electrode (Z) formed on an upper substrate 10, and an address electrode (X) formed on a lower substrate 18. Each of the scan electrode (Y) and the sustain electrode (Z) includes transparent electrodes 12Y and 12Z and metal bus electrodes 13Y and 13Z having line widths narrower than line widths of the transparent electrodes 12Y and 12Z formed at one-sided edge regions of the transparent electrodes 12Y and 12Z.

The transparent electrodes 12Y and 12Z are generally formed of Indium-Tin-Oxide (hereinafter, referred to as 'ITO') on the upper substrate 10. The metal bus electrodes 13Y and 13Z are generally formed of chrome (Cr) on the transparent electrodes 12Y and 12Z to function to reduce a voltage drop caused by the transparent electrodes 12Y and 12Z having high resistance. An upper dielectric layer 14 and a passivation film 16 are layered on the upper substrate 10 having the scan electrode (Y) and the sustain electrode (Z) formed in parallel with each other. The wall charge generated at the time of plasma discharge is stored in the upper dielectric layer 14. The passivation film 16 prevents the upper dielectric layer 14 from being damaged due to the sputtering generating at the time of the plasma discharge and also, enhances an emission efficiency of a secondary electron. Magnesium oxide (Mgo) is generally used as the passivation film 16. A lower dielectric layer 22 and a barrier 24 are formed on the lower substrate 18 having the address electrode (X), and a fluorescent layer 26 is coated on a surface of the lower dielectric layer 22 and the barrier 24. The address electrode (X) is formed in a direction of crossing with the scan electrode (Y) and the sustain electrode (Z). The barrier 24 is formed in parallel with the address electrode (X) to prevent the visible ray and the ultraviolet ray caused by the discharge from being leaked to an adjacent discharge cell. The fluorescent layer 26 is excited by the ultraviolet ray generated due to the plasma discharge to radiate any one visible ray of red, green or blue. The inert mixture gas for the discharge such as He+Xe, Ne+Xe, He+Ne+Xe and the like is injected into a discharge space of the discharge cell provided between the upper/lower substrates 10 and 18 and the barrier 24.

In the above three-electrode AC surface discharge type PDP, one frame is divided into several sub-fields having different times of light-emitting (for example, the number of a sustain pulse) so as to realize a gray level of the image. Each of the sub-fields is again divided into a reset period during which the discharge is uniformly generated, an address period during which the discharge cell is selected, and the sustain period during which the gray level is embodied depending on discharge times. For example, in case that the image is expressed using a 256 gray level as in FIG. 2, a frame period (16.67 ms) corresponding to 1/60 second is divided into eight sub-fields (SF1 to SF8). Also, each of the eight sub-fields (SF1 to SF8) is again divided into a reset period, an address period and a sustain period. Herein, the reset and address periods of each sub-field are identical every sub-field, whileas the sustain period is increased in a ratio of $2^n$ (n=0, 1, 2, 3, 4, 5, 6, 7) at each of the sub-fields. As described above, brightness weighting values different from one another every sub-field are combined to embody a certain gray level.

On the other hand, the conventional PDP can control the number of the sustain pulse depending on an Average Picture Level (hereinafter, referred to as "APL") such that a consumption power can be constantly processed.

FIG. 3 is a general graph illustrating the number of the sustain pulse depending on the APL.

Referring to FIG. 3, since brightness is determined depending on the number of the sustain pulse, if a total number of the sustain pulse is made identical in cases that an average brightness is dark and bright, the PDP has several drawbacks of a picture quality deterioration, a power consumption, a panel damage and the like. For example, a contrast is decreased in case that the number of the sustain pulse is set to be small for all inputted images. Further, in case that the number of the sustain pulse is set to be large for all inputted images, the PDP has an advantage in that the brightness is bright and the contrast is increased even at a dark image, but the panel can be damaged due to an increased consumption power and an elevated temperature of the panel. Accordingly, it is required to properly adjust the total number of the sustain pulse depending on the average brightness of the inputted image. Herein, the number of the sustain pulse is abruptly increased in a range of gray level having a relative low APL, and is decreased in a range of gray level having a relative high APL. Accordingly, the number of the sustain pulse is abruptly varied in the range of gray level having the relative low APL.

FIG. 4 is a view illustrating a voltage waveform representing a conventional driving method of the PDP.

Referring to FIG. 4, the sub-field (SF) included in one frame of the PDP is divided for an operation into the reset period (RPD), the address period (APD) and the sustain period (SPD).

A reset pulse (RP) is supplied to the scan electrode (Y) during the reset period (RPD). The reset pulse (RP) having a ramp wave format is in a way of increasing voltage during a set-up period and decreasing the voltage during a set-down period. In the set-up period during which the voltage is gradually increased, a plurality of minute set-up discharges is generated to form the wall charge in the upper dielectric layer. Continuously, in the set-down period during which the voltage is gradually decreased, unnecessary charged particles are partially removed due to a plurality of minute set-down charges such that the wall charge is decreased as much as a next address discharge is helped without an erroneous discharge. A positive-polar (+) direct-current voltage is supplied to the sustain electrode (Z) during the set-down period. Since the reset pulse (RP) is supplied gradually attenuating with respect to the positive-polar (+) direct-current voltage, the scan electrode (Y) has a relative negative polarity (−) with respect to the sustain electrode (Z), that is, polarity is inverted at the time of set-down thereby causing the wall charges generated at the time of set-up to be decreased.

During the address period (APD), a scan pulse (SP) having a negative-polar (−) scan voltage (Vy) is supplied to the scan electrode (Y) and at the same time, a positive-polar (+) data pulse (DP) is supplied to the address electrode (x) thereby causing the address discharge. The wall charge formed due to the address discharge is maintained during a period during which other discharge cells are addressed.

During the sustain period (SPD), a triggering pulse (TP) is supplied to the scan electrode (Y) such that a sustain discharge is initiated at the discharge cells where enough wall charges are formed during the address period (APD). Next, sustain pulses (SUSPz and SUSPy) corresponding to the sustain voltage (Vs) are alternatively supplied to the sustain electrode. (Z) and the scan electrode (Y) such that the sustain discharge is maintained during the sustain period (SPD)

During an erase period (EPD) following the sustain period (SPD), an erase pulse (EP) is supplied to the sustain electrode (Z) thereby stopping the maintained discharge. The erase pulse has the ramp wave format to provide small-sized light-emitting, or a short pulse width of about 1 μs for a discharge erase. The charged particles are erased using a short erase discharge caused by the erase pulse (EP), to thereby stop the discharge.

On the other hand, in the conventional art, the reset period (RPD) and the address period (APD) are identical every sub-field within one frame, whileas the sustain period (SPD) is increased in the ratio of $2^n$ (n=0, 1, 2, 3, 4, 5, 6, 7) at each of the sub-fields. Since the sustain period (SPD) is different at each of the sub-fields as described above, the gray level of LB the image can be embodied. However, since the frames are identically arranged every vertical synchronous signal as in FIG. 5, the gray level is limitedly expressed. In FIG. 5, the number of the sub-field is 12, and the number of the sub-field can be variously varied depending on the gray level to be embodied.

Accordingly, in order to overcome a limitation in expressing the gray level, it has been proposed that two frames of FIGS. 6A and 6B be alternatively arranged every vertical synchronous signal. For example, the sub-fields are arranged at an odd frame (or an even frame) in a weighted value ratio of 1, 6, 13, 23, 35, 51, 70, 91, 116, 145, 176 and 211 as in FIG. 6A, and the sub-fields are arranged at the even frame (or the odd frame) in a weighted value ratio of 4, 9, 18, 29, 43, 60, 80, 103, 130, 160, 193 and 109 as in FIG. 6B. In case that the odd frame and the even frame having the different brightness weighting value of each sub-field are alternatively used every vertical synchronous signal (Vsync), an expression degree of the gray level can be increased at least twice as much as the case where the frames having the same brightness weighting value of each sub-field are arranged. At this time, the brightness weighting values of the sub-field should be set to be alternated each other every-frame.

For example, the brightness weighting values of the odd frame and the even frame can be set to be alternated such as 1, 4, 6, 9, 13, 18, 23, 29 and the like.

However, in case that the brightness weighting value is alternatively arranged every frame as described above, there is a drawback in that light-emitting centers of each frame are inconsistent, and a flicker is generated to an extent of being unpleasant to the eye thereby deteriorating the picture quality.

That is, when all sub-fields of each frame are turned-on, a light-emitting center of an odd numbered frame is a 211 position of the brightness weighting value, whileas a light-emitting center of an even numbered frame is a 193 position of the brightness weighting value. Accordingly, the positions of the light-emitting centers of both frames are different from each other thereby causing the flicker and accordingly, critically influencing the picture quality.

Describing this in detail, in case that two frames having different brightness weighting values are alternatively arranged, a vertical frame blank (hereinafter, referred to as "VFB") period between an $n^{th}$ frame (n) and a $(n+1)^{th}$ frame (n+1) becomes T1, and a VFB between the $(n+1)^{th}$ frame (n+1) and a $(n+2)^{th}$ frame (n+2) becomes T1 as in FIG. 6C. As illustrated in FIG. 6C, it can be understood that T2 is longer than T1. Further, BFBs between the frames are alternatively arranged. At this time, since T1 and T2 are different from each other, the light-emitting centers of respective frames are inconsistent to cause the flicker to the extent of being unpleasant to the eye thereby deteriorating the picture quality.

On the other hand, a selective write and selective erase (SWSE) driving method has been proposed for reinforcing the expression degree of the gray level. In the above selective write and selective erase driving method, one frame is comprised of at least one selective write sub-field and at least one selective erase sub-field.

FIG. 7 is a view illustrating a waveform representing a conventional driving method of a selective write and selective erase PDP driven in a 60 Hz mode.

Referring to FIG. 7, one frame of the selective write and selective erase PDP is comprised of at least one selective write sub-field and at least one selective erase sub-field. At this time, the at least one selective write sub-field can be a selective write duration (SW6 and the like), and the at least one selective erase sub-field can be a selective erase duration (SE1, SE2 and the like).

Further, the selective write sub-field is divided into a reset period (IPD), an address period (APD), and a sustain period (SPD), and the selective erase sub-field is divided into an address period (APD) and a sustain period (SPD).

Describing this in detail, a set-down waveform ramp pulse (-RP) is sequentially supplied during the reset period (RPD) of the selective write sub-field to scan electrode lines (Y) following a set-up waveform reset pulse (RP). The set-down waveform ramp pulse (−RP) drops to a negative-polar (−) scan reference voltage (−Vw). Further, a positive-polar (+) direct-current voltage is supplied to sustain electrode lines (Z)

While the positive-polar (+) direct-current voltage is supplied to the sustain electrode lines (Z) during the address period (APD) of the selective write sub-field, a negative-polar (−) selective write scan pulse (SWSP) and a positive-polar (+) selective write data pulse (SWDP) are supplied to each of the scan electrode lines (Y) and the address electrode lines (X) to be synchronized with each other. Continuously, sustain pulses (SUSPy and SUSPz) are alternatively supplied to the scan electrode lines (Y) and the sustain electrode lines (Z) such that the sustain discharge is generated at a cell turned-on by the address discharge of the selective write sub-field during the sustain period (SPD) of the selective write sub-field.

The reset period (RPD) of the selective erase sub-field is omitted. During the address period (APD) of the selective erase sub-field, a negative-polar (−) selective erase scan pulse (SESP) and a positive-polar (+) selective erase data pulse (SEDP) are supplied to each of the scan electrode lines (Y) and the address electrode lines (X) to be synchronized with each other. The selective erase scan pulse (SESP) drops to a negative-polar (−) selective erase scan voltage (Ve) higher than the negative-polar (−) scan reference voltage (Vw).

The sustain pulses (SUSPy and SUSPz) are alternatively supplied to the scan electrode lines (Y) and the sustain electrode lines (Z) such that the sustain discharge is generated at cells not turned-off by the address discharge of the selective erase sub-field (ESF) during the sustain period (SPD) of the selective erase sub-field. In case that a next following sub-field is the selective erase sub-field, the sustain pulse (SUSPy) having a relatively large pulse width is supplied to the scan electrode lines (Y) at the end time of a present selective erase sub-field. Additionally, an erase pulse (not shown) and a ramp signal (not shown) are supplied to the scan electrode lines (Y) and the sustain electrode lines (z) at the last selective erase sub-field having the selective write sub-field as the next sub-field to erase the sustain discharge of the turned-on cells.

FIG. 8 is a view illustrating an example of a sub-field arrangement where the gray level is expressed in a selective write and selective erase way of FIG. 7.

Referring to FIG. 8, in order to express the gray level, the sub-field from a low gray level to a first 32 gray level is addressed in a selective write way, and remaining sub-fields are addressed in a selective erase way. At this time, in case that a 50 Hz driving is performed using the selective write and selective erase way, the flicker is caused by a phenomenon of a relative VFB increase (that is, VFB*(vertical frame blank at the time of a 60 Hz driving)<VFB** (vertical frame blank at the time of the 50 Hz driving)). The above flicker is an obstacle in the picture quality. Describing this in detail, in case that it is intended to display the-image, South Korea and United Stated America use the 60 Hz mode, that is, the frame period (16.67 ms) corresponding 1/60 second. However, Europe, China and the like use a 50 Hz mode, that is, a frame period (20 ms) corresponding to 1/50 second. At this time, in case that one frame period is 60 Hz, the VFB period is VFB*. However, in case that a signal of the 60 Hz mode is applied to the 50 Hz mode, the VFB period is VFB** longer than the case of 60 Hz. Accordingly, since the VFB* period of the 60 Hz mode is short and the VFB** period of the 50 Hz mode is long, in case that the frame of the 60 Hz mode is applied to the 50 Hz mode, there is a drawback in that since the VFB period is lengthened thereby causing the phenomenon of inconsistency of the light-emitting centers, the flicker is caused thereby deteriorating the brightness.

SUMMARY OF THE INVENTION

Accordingly, the present invention is directed to a driving method of a plasma display panel that substantially obviates one or more problems due to limitations and disadvantages of the related art.

An object of the present invention is to provide a driving method of a plasma display panel in which light-emitting centers coincide with one another every frame to improve a picture quality.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a driving method of a plasma display panel characterized in that one frame period of the $n^{th}$ frame or the $(n+1)^{th}$ frame is variably set such that a brightness expression period can be identically set at the $n^{th}$ frame and the $(n+1)^{th}$ frame.

At this time, each of the $n^{th}$ frame and the $(n+1)^{th}$ frame can include: a reset period during which a uniform wall charge is formed at a discharge cell; an address period during which an address discharge is generated to select the discharge cell; and a sustain period during which a sustain discharge is generated in the discharge cell where the address discharge is generated at predetermined times depending on a gray level value.

The frame period can be varied by the address period or the sustain period. At this time, the address period varying the frame period can be varied by increase or decrease of a first period during which the wall charge formed during the address period is maintained. Further, the sustain period varying the frame period can be varied by increase or decrease of a second period during which the wall charge formed during the sustain period is maintained.

Additionally, the address period and the sustain period may be differently varied depending on an average picture level (APL).

Meanwhile, the frame period is varied by both of the address period and the sustain period.

In another aspect of the present invention, there is provided a driving method of a plasma display panel characterized in that one frame period of the selective write and selective erase frame driven in the 60 Hz mode or the selective write and selective erase frame driven in the 50 Hz mode is variably set such that a brightness expression period can be identically set at the selective write and selective erase frame driven in the 60 Hz mode and the selective write and selective erase frame driven in the 50 Hz mode.

At this time, each of the selective write and selective erase frame driven in the 60 Hz mode and the selective write and selective erase frame driven in the 50 Hz mode, can include: at least one selective write sub-field having a reset period during which a uniform wall charge is formed at a discharge cell, an address period during which an address discharge is generated to select the discharge cell, and a sustain period during which a sustain discharge is generated in the discharge cell where the address discharge is generated at predetermined times depending on a gray level value; and at least one selective erase sub-field having an address period during which an address discharge is generated to select the discharge cell, and a sustain period during which a sustain discharge is generated at predetermined times depending on a gray level value, at the discharge cells where the address discharge is generated.

The frame period can be varied by at least one period among the address period of the selective write sub-field, the sustain period of the selective write sub-field, the address period of the selective erase sub-field, and the sustain period of the selective erase sub-field. At this time, the address period of the selective write sub-field varying the frame period is varied by increase or decrease of a first period during which the wall charge formed during the address period of the selective write sub-field is maintained. Further, the sustain period of the selective write sub-field varying the frame period can be varied by increase or decrease of a second period during which the wall charge formed during the sustain period of the selective write sub-field is maintained. Further, the address period of the selective erase sub-field varying the frame period can be varied by increase or decrease of a third period during which the wall charge formed during the address period of the selective erase sub-field is maintained.

Also, the sustain period of the selective erase sub-field varying the frame period is varied by increase or decrease of a fourth period during which the wall charge formed during the sustain period of the selective erase sub-field is maintained.

The address period of the selective write sub-field, the sustain period of the selective write sub-field, the address period of the selective erase sub-field and the sustain period of the selective erase sub-field may be differently varied depending on an AVL.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
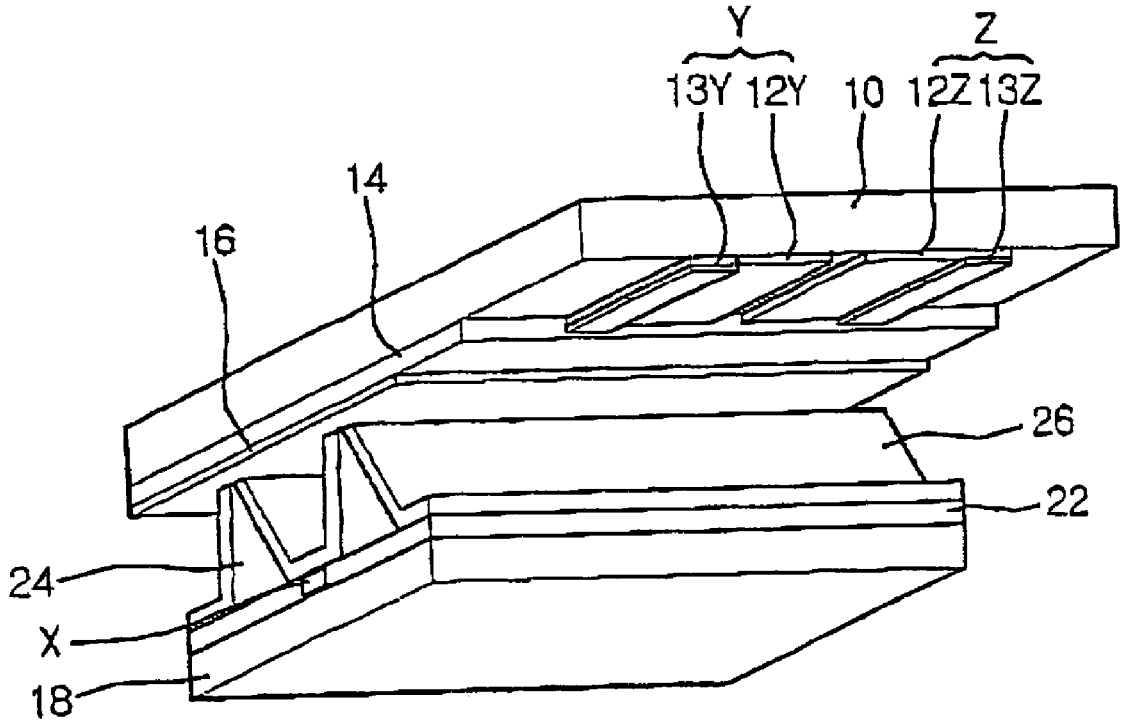
Fig.1 Related Art
FIG. 1 is a view illustrating a discharge cell of a conventional three-electrode AC surface discharge type plasma display panel.
Figure 2:
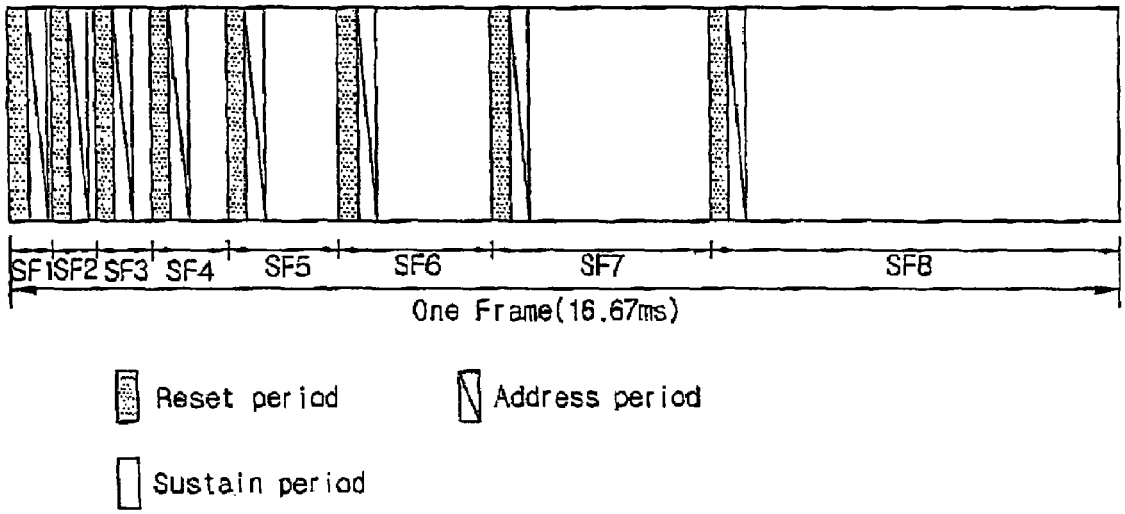
Fig.2 Related Art
FIG. 2 is a view illustrating a general frame comprised of eight sub-fields.
Figure 3:
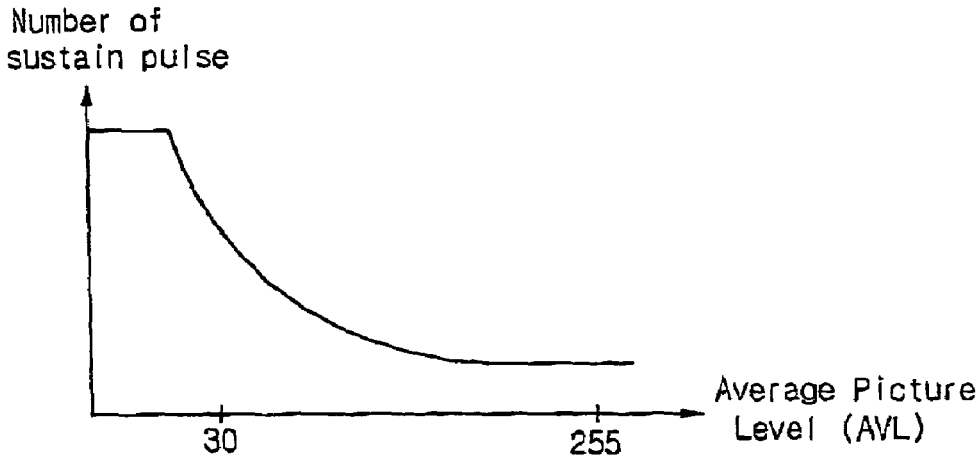
Fig.3 Related Art
FIG. 3 is a general graph illustrating the number of a sustain pulse depending on an ANAL (Average Picture Level)
Figure 4:
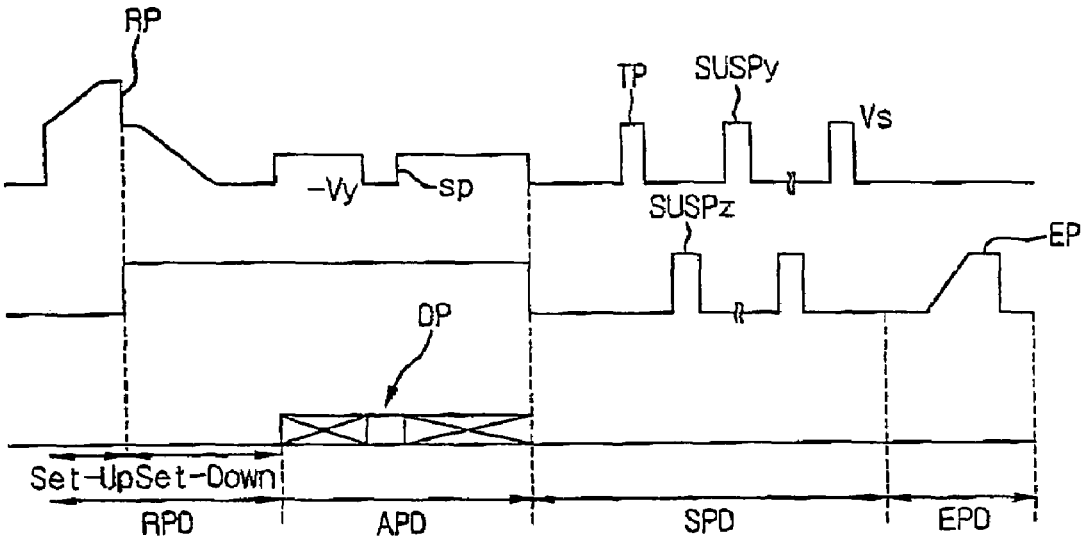
Fig.4 Related Art
FIG. 4 is a view illustrating a voltage waveform representing a conventional driving method of a PDP.
Figure 5:
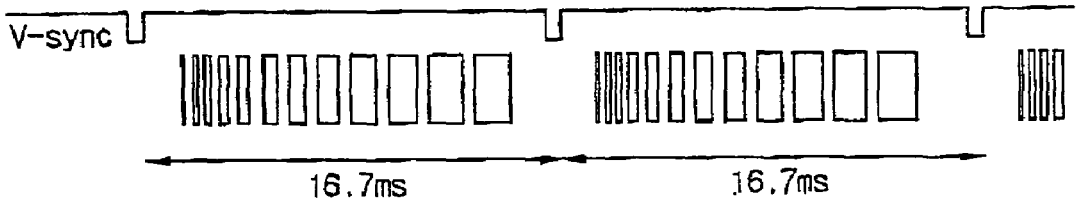
Fig.5 Related Art
FIG. 5 is a view illustrating a way of arranging a frame according to a conventional driving method of a PDP.
Figure 6A:
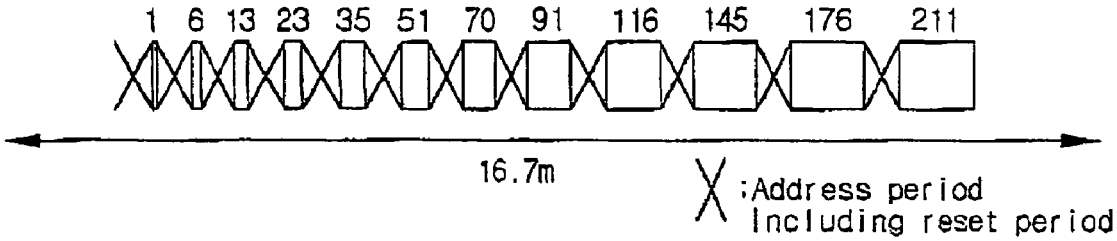
Fig.6A Related Art
FIGS. 6A and 6B are view illustrating arrangements of frames having different brightness weighting values.
Figure 6B:
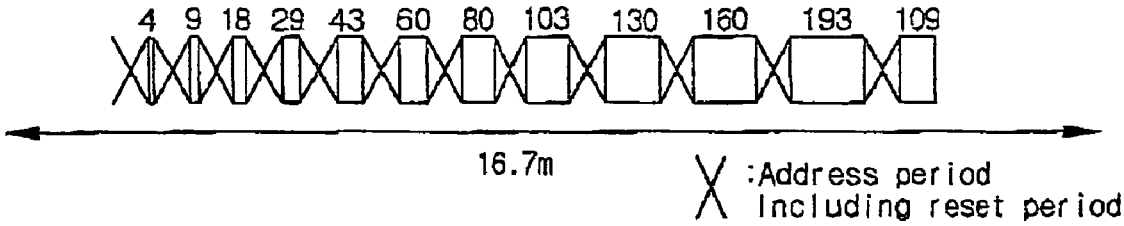
Fig.6B Related Art
Figure 6C:
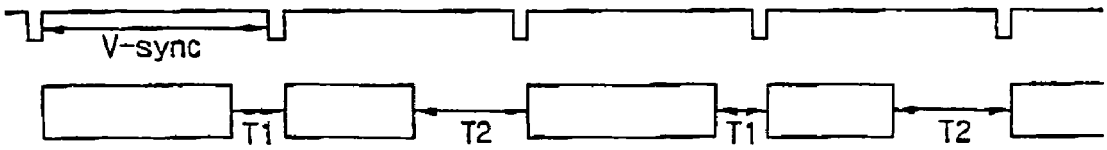
Fig.6C Related Art
FIG. 6C is a view illustrating vertical frame blank periods between respective frames being different from one another when frames of FIGS. 6A and 6B are alternatively arranged.
Figure 7:
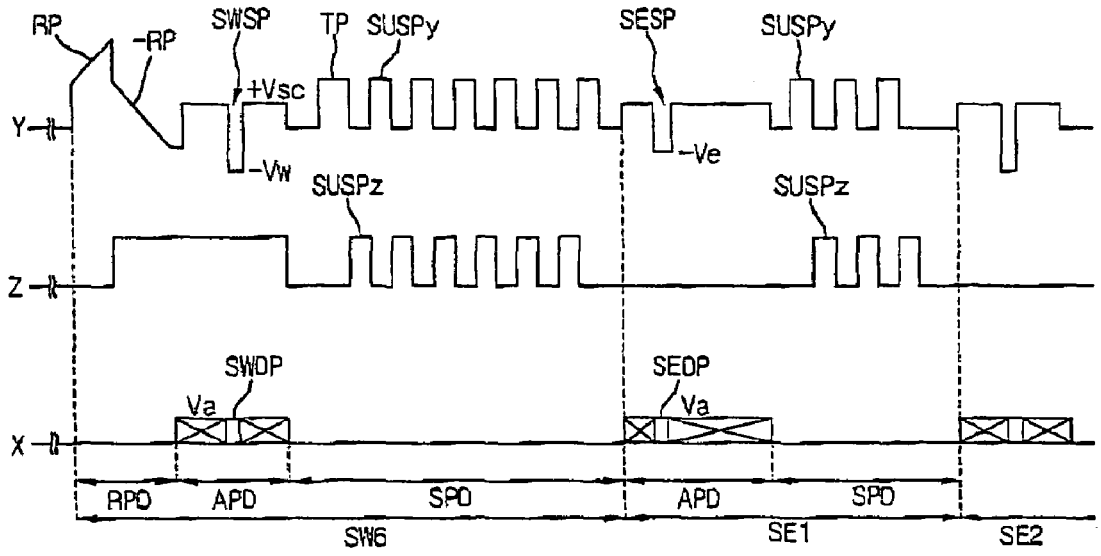
Fig.7 Related Art
FIG. 7 is a view illustrating a waveform representing a conventional driving method of a selective write and selective erase PDP driven in a 60 Hz mode.
Figure 8:
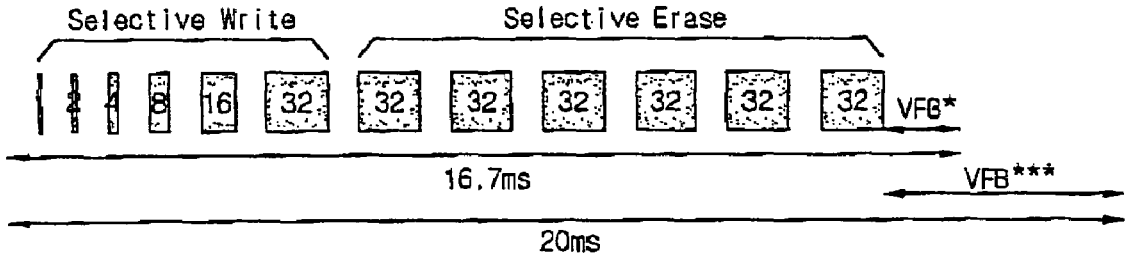
Fig.8 Related Art
FIG. 8 is a view illustrating an example of a sub-field arrangement where a gray level is expressed in a selective write and selective erase way of FIG. 7.
Figure 9:
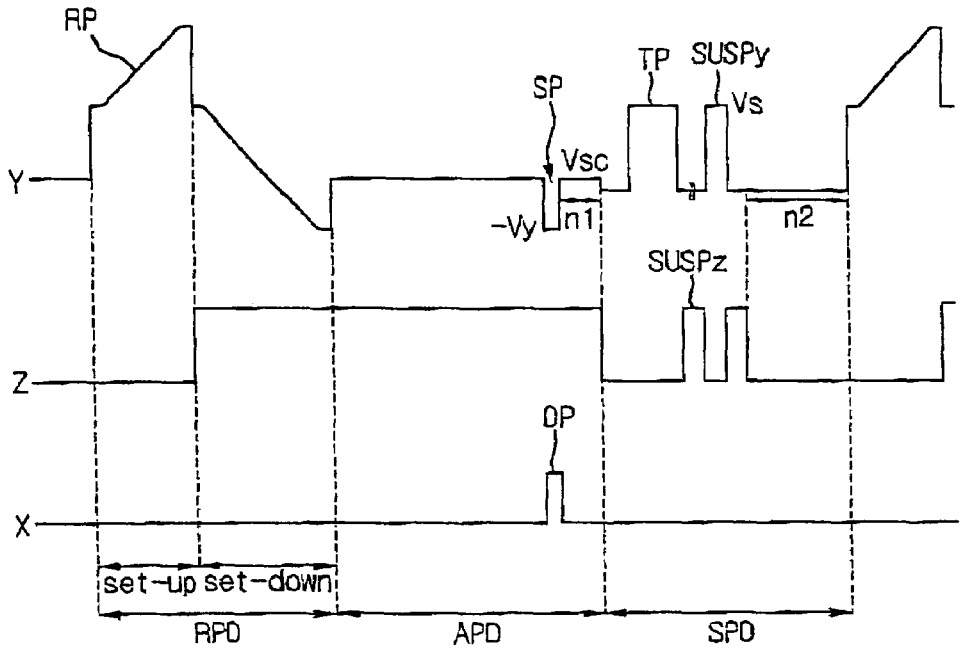
FIG. 9 is a view illustrating a voltage waveform representing a driving method of a PDP according to a first embodiment of the present invention.

FIG. 9 is a view illustrating a voltage waveform representing a driving method of a Plasma Display Panel (PDP) according to a first embodiment of the present invention.

Herein, in the PDP, two frames are alternatively arranged every vertical synchronous signal so as to increase gray level expression.

Referring to FIG. 9, a sub-field (SF) included in one frame of the PDP is divided for an operation into a reset period (RPD), an address period (APD) and a sustain period (SPD).

A reset pulse (RP) is supplied to a scan electrode (Y) during the reset period (RPD). The reset pulse (RP) having a ramp wave format is in a way of increasing voltage during a set-up period and decreasing the voltage during a set-down period. During the set-up period during which the voltage is gradually increased, a plurality of minute set-up discharges is generated to form the wall charge in an upper dielectric layer. Continuously, during the set-down period during which the voltage is gradually decreased, unnecessary charged particles are partially removed due to a plurality of minute set-down charges such that the wall charge is decreased as much as a next address discharge is helped without an erroneous discharge. At this time, a positive-polar (+) direct-current voltage is supplied to a sustain electrode (Z) during the set-down period. Since the reset pulse (RP) is supplied gradually attenuating with respect to the positive-polar (+) direct-current voltage, the scan electrode (Y) has a relative negative polarity (−) with respect to the sustain electrode (Z), that is, polarity is inverted at the time of set-down thereby causing the wall charges generated at the time of set-up to be decreased.

During the address period (APD), a scan pulse (SP) having a negative-polar (−) scan voltage (Vy) is supplied to the scan electrode (Y) and at the same time, a positive-polar (+) data pulse (DP) is supplied to the address electrode (X) thereby causing an address discharge. The wall charge formed due to the address discharge is maintained during a period during which other discharge cells are addressed. At this time, a first period (n1) of FIG. 9 is variably varied depending on the APL, as a period during which the scan voltage (Vsc) is continuously maintained after the scan pulse (SP) is applied. By doing so, in case that two frames having different brightness weighting values are alternatively arranged to increase the number of the gray level, a flicker caused by inconsistent light-emitting centers is removed. That is, the second period (n2) is variably varied depending on the APL so as to coincide the light-emitting centers such that the flicker is removed thereby improving brightness.

Figure 10:
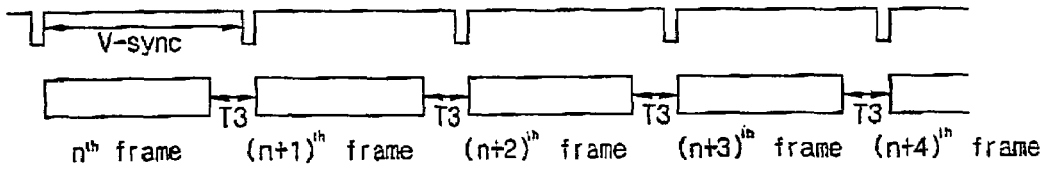
FIG. 10 is a view illustrating vertical frame blank periods between respective frames being identical with one another when a voltage waveform of FIG. 9 is applied.
Figure 11A:
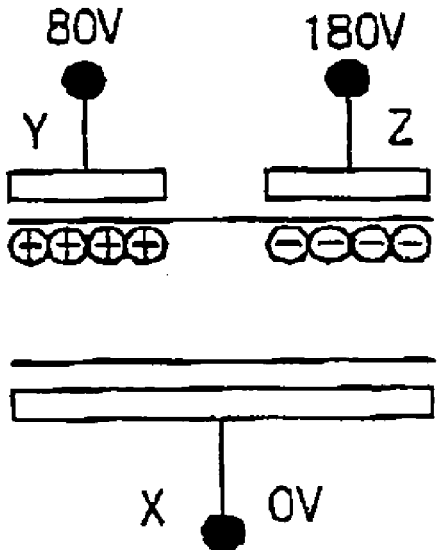
FIGS. 11A and 11B are views illustrating wall charges not varied during first and second periods of FIG. 9.

Describing this in detail, if the APL is at a low level during the address period (APD), the first period (n1) is shortened, and if the APL is at a high level, the first period (n1) is lengthened. That is, since many sustain pulses are generated if the APL is at the low level, the first period (n1) is shortened, and since a few sustain pulses are generated if the APL is at the high level, the first period (n1) is lengthened. The address period (APD) of each of the sub-fields is varied by variably varying the first period (n1) depending on the APL as in FIG. 12. Accordingly, as in FIG. 10, an interval (T3) of a vertical frame blank (VFB) period between the frames is constantly maintained. That is, periods during which brightness of an $n^{th}$ frame and a $(n+1)^{th}$ frame are expressed as in FIG. 10 are identically set by varying the address period (APD) of each of the sub-fields. Accordingly, since the light-emitting centers are consistent with one another thereby removing the flicker, the brightness is improved. At this time, the first period (n1) of FIG. 9 has a characteristic of not varying the wall charge as in FIG. 11A even though a period of 100 μs is maintained.

During the sustain period (SPD), a triggering pulse (TP) is supplied to the scan electrode (Y) such that a sustain discharge is initiated in the discharge cells where enough wall charges are formed during the address period (APD). Next, sustain pulses (SUSPz and SUSPy) corresponding to the sustain voltage (Vs) are alternatively supplied to the sustain electrode (z) and the scan electrode (Y) such that the sustain discharge is maintained during the sustain period (SPD). At this time, a second period (n2) of FIG. 9 is variably varied depending on the APL, as a period till before a next sub-field begins after a last sustain pulse (SUSPz) is supplied during the sustain period (SPD) By doing so, in case where two frames having the different brightness weighting values are alternatively arranged to increase the number of the gray level, the flicker caused by the inconsistent light-emitting centers is removed. That is, the second period (n2) is variably varied depending on the APL so as to coincide the light-emitting centers such that the flicker is removed thereby improving the brightness.

Figure 11B:
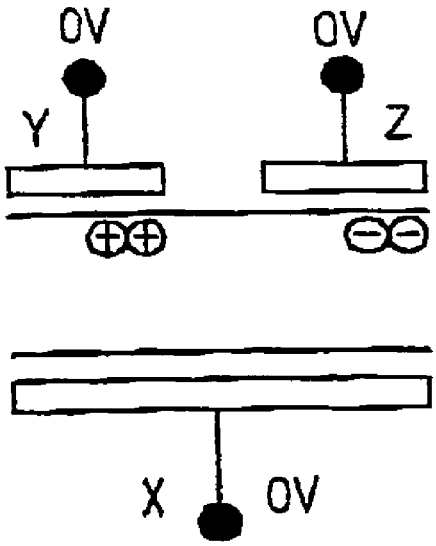

Describing this in detail, if the APL is at the low level during the sustain period (APD), the second period (n2) is shortened as the period till before the next sub-field begins after the last sustain pulse (SUSPz) is supplied, and if the APL is at the high level, the second period (n2) is lengthened. That is, if the APL is at the low level, many sustain pulses are generated thereby causing much time to be relatively taken. Therefore, the second period (n2) is allowed to be short thereby secure the shortened time. To the contrary, if the APL is at the high level, the few sustain pulses are generated thereby causing little time to be relatively taken. Therefore, the second period (n2) can be lengthened. Accordingly, as the second period (n2) is varied depending on the APL, the sustain period is also varied to allow a length of each frame to be constant such that the interval of the vertical frame blank (VFB) period between the frames are constantly maintained thereby coinciding the light-emitting centers. That is, a variation of the address period (APD) of each of the sub-fields allows the periods during which the brightness of the $n^{th}$ frame and the $(n+1)^{th}$ frame are expressed as in FIG. 10 to be identically set. Accordingly, since the flicker is removed, the brightness is improved. At this time, the second period (n2) of FIG. 9 has the characteristic of not varying the wall charge as in FIG. 11B even though the period of 100 μs is maintained.

At this time, any one of the first period (n1) or the second period (n2) can be variably varied to coincide the light-emitting centers or, the first period (n1) or the second period (n2) can be all variably varied to coincide the light-emitting centers.

Figure 13:
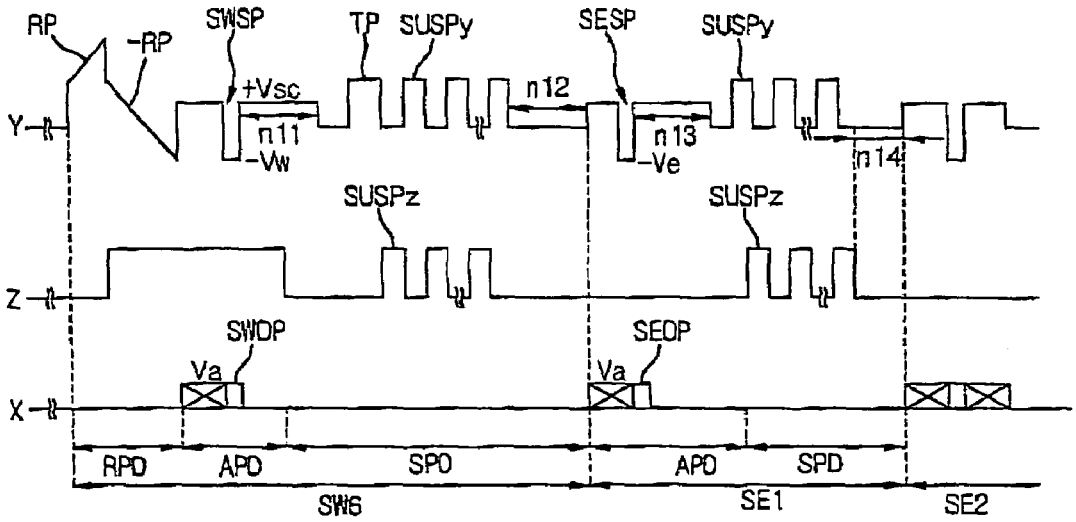
FIG. 13 is a view illustrating a voltage waveform representing a driving method of a selective write and selective erase PDP according to a second embodiment of the present invention.

FIG. 13 is a view illustrating a voltage waveform representing a driving method of a selective write and selective erase PDP according to a second embodiment of the present invention.

Referring to FIG. 13, one frame of the selective write and selective erase PDP is comprised of at least one selective write sub-field and at least one selective erase sub-field. At this time, the at least one selective write sub-field can be a selective write duration (SW6 and the like), and the at least one selective erase sub-field can be a selective erase duration (SE1, SE2 and the like).

Further, the selective write sub-field is divided into a reset period (RPD), an address period (APD) and a sustain period (SPD), and the selective erase sub-field is divided into an address period (APD) and a sustain period (SPD).

During the reset period (RPD) of the selective write sub-field, a set-down waveform ramp pulse (-RP) is sequentially supplied to scan electrode lines (Y) following a set-up waveform reset pulse (RP). The set-down waveform ramp pulse (−RP) drops to a negative-polar (−) scan reference voltage (−Vw). Further, a positive-polar (+) direct-current voltage is supplied to sustain electrode lines (Z).

While the positive-polar (+) direct-current voltage is supplied to the sustain electrode lines (Z) during the address period (APD) of the selective write sub-field, a negative-polar (−) selective write scan pulse (SWSP) and a positive-polar (+) selective write data pulse (SWDP) are supplied to each of the scan electrode lines (Y) and the address electrode lines (X) to be synchronized with each other. At this time, a first period (n11) of FIG. 13 is variably varied depending on an APL, as a period during which a scan voltage (Vsc) is continuously maintained after the scan pulse (SWSP) is applied during the address period (APD). By doing so, in case that a 60 Hz mode is applied to a 50 Hz mode, a flicker caused by inconsistent light-emitting centers is removed. That is, the first period (n11) is variably varied depending on the APL to coincide the light-emitting centers such that the flicker is removed thereby improving brightness.

Figure 12:
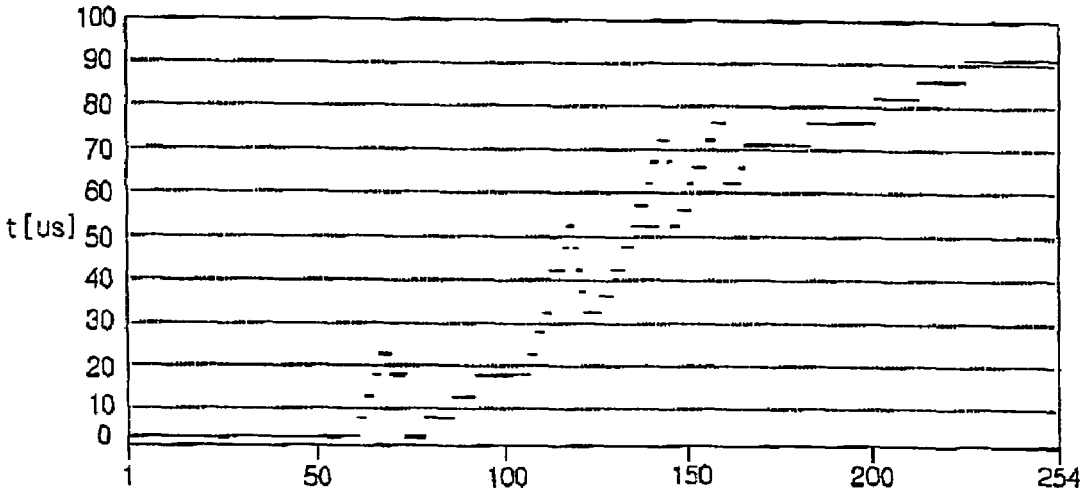
FIG. 12 is a view illustrating first and second periods of FIG. 9 depending on an AVL.
Figure 14A:
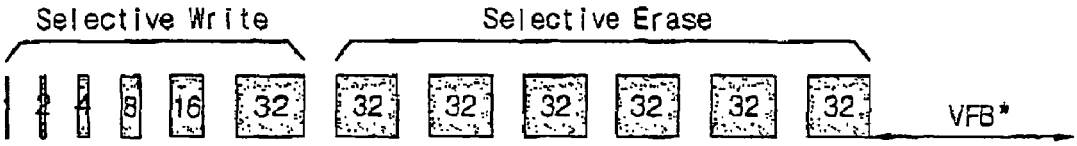
FIG. 14A is a view illustrating a frame before a second embodiment of the present invention is applied.
Figure 14B:
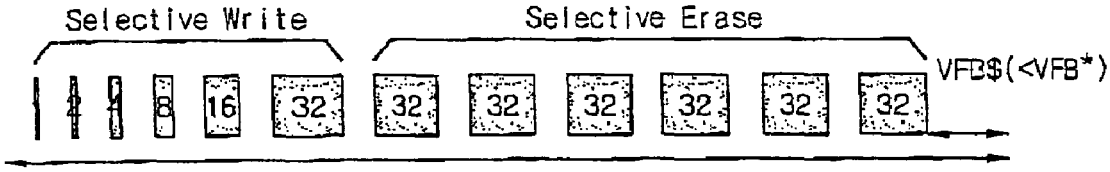
FIG. 14B is a view illustrating a frame after a second embodiment of the present invention is applied.

Describing this in detail, in order to solve a drawback in which the flicker is caused thereby reducing the brightness in case that the 60 Hz mode is applied to the 50 Hz mode, the first period (n11) of FIG. 13 is variably varied depending on an APL, as the period during which the scan voltage (Vsc) is continuously maintained after the scan pulse (SWSP) is applied to during the address period (APD), such that the address period (APD) of each sub-field is lengthened to reduce a long vertical frame blank (VFB*) period as in FIG. 14A to a short vertical frame blank (VFB$) period as in FIG. 14B. That is, the periods during which the brightness is expressed are identically set as in FIG. 14B by varying the address period (APD) of each sub-field. By doing so, in case that the 60 Hz mode is applied to the 50 Hz mode, the light-emitting centers coincide with one another such that the flicker is removed thereby improving the brightness. Herein, the first period (n11) is maintained during a different period depending on the APL as shown in FIG. 12.

Sustain pulses (SUSPy and SUSPz) are alternatively supplied to the scan electrode lines (Y) and the sustain electrode lines (z) such that a sustain discharge is generated at a cell turned-on by the address discharge of the selective write sub-field during the sustain period (SPD) of the selective write sub-field. At this time, a second period (n12) of FIG. 13 is variably varied depending on the APL, as the period till before a next sub-field begins after the last sustain pulse (SUSPy) is supplied during the sustain period (SPD), such that the sustain period (SPD) of each sub-field is lengthened to reduce the long vertical frame blank (VFB*) period as in FIG. 14A to the short vertical frame blank (VFB$) period as in FIG. 14B. By doing so, in case that the 60 Hz mode is applied to the 50 Hz mode, the light-emitting centers coincide with one another such that the flicker can be removed thereby improving the brightness. Herein, the second period (n12) is maintained during a different period depending on the APL as shown in FIG. 12.

The reset period (RPD) of the selective erase sub-field is omitted. During the address period (APD) of the selective erase, sub-field, a negative-polar (−) selective erase scan pulse (SESP) and a positive-polar (+) selective erase data pulse (SEDP) are supplied to each of the scan electrode lines (Y) and the address electrode lines (X) to be synchronized with each other. The selective erase scan pulse (SESP) drops to a negative-polar (−) selective erase scan voltage (Ve) higher than the negative-polar (−) scan reference voltage (Vw) At this time, a third period (n13) of FIG. 13 is variably varied depending on the APL, as a period during which the scan voltage (Vsc) is continuously maintained after the scan pulse (SESP) is applied during the address period (APD), such that the address period (APD) of each sub-field is lengthened to reduce the long vertical frame blank (VFB*) period as in FIG. 14A to the short vertical frame blank (VFB$) period as in FIG. 14B. By doing so, in case that the 60 Hz mode is applied to the 50 Hz mode, the light-emitting centers coincide with one another such that the flicker can be removed thereby improving the brightness. Herein, the third period (n13) is maintained during a different period depending on the APL as shown in FIG. 12.

The sustain pulses (SUSPy and SUSPz) are alternatively supplied to the scan electrode lines (Y) and the sustain electrode lines (Z) such that the sustain discharge is generated at the cells not turned-off by the address discharge of the selective erase sub-field during the sustain period (SPD) of the selective erase sub-field. At this time, a fourth period (n14) of FIG. 13 is variably varied depending on the APL, as a period till before the next sub-field begins after the last sustain pulse (SUSPz) is supplied during the sustain period (SPD), such that the sustain period (SPD) of each sub-field is lengthened to reduce the long vertical frame blank (VFB*) period as in FIG. 14A to the short vertical frame blank (VFB$) period as in FIG. 14B. That is, the periods during which the brightness is expressed are identically set as in FIG. 14B by varying the sustain period (SPD) of each sub-field. By doing so, in case that the 60 Hz mode is applied to the 50 Hz mode, the light-emitting centers coincide with one another such that the flicker can be removed thereby improving the brightness. Herein, the fourth period (n14) is maintained during the different period depending on the APL as shown in FIG. 12.

At this time, at least one of the first to fourth is periods (n1 to n4) is variably varied such that the light-emitting centers can coincide with one another.

As described above, in the driving method of the plasma display panel according to the present invention, the period between respective sub-fields or the period after the scan pulse during which the wall charge can be maintained without variation so as not to generate the erroneous discharge, are controlled depending on the APL such that the flicker can be removed thereby improving the picture quality.

Further, the flicker caused by a way in which at least two frames are alternatively used every vertical synchronous signal to thereby increase the expression degree and the flicker caused by the 50 Hz mode can be removed thereby improving the picture quality.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A driving method of a plasma display panel comprising:

arranging a $n^{th}$ frame having a first brightness weighting value and a $(n+1)^{th}$ frame having a different brightness weighting value from the first brightness weighting value alternatively at every vertical synchronous signal to display a certain image; and setting one frame period of at least one of the $n^{th}$ frame and the $(n+1)^{th}$ frame variably for the $n^{th}$ frame and the $(n+1)^{th}$ frame to have a same period of brightness expression period, the frame period is varied by an address period or a sustain period, the address period is varied by increasing or decreasing a first period, and the first period is a period during which formed wall charges are maintained.

2. The driving method according to claim 1, wherein each of the $n^{th}$ frame and the $(n+1)^{th}$ frame comprises: a reset period during which a uniform wall charge is formed in a discharge cell; an address period during which an address discharge is generated to select the discharge cell; and a sustain period during which a sustain discharge is generated at predetermined times depending on a gray level value, in the discharge cell where the address discharge is generated.

3. The driving method according to claim 1, wherein the sustain period is varied by increasing or decreasing a second period, wherein the second period is a period during which the formed wall charges are maintained.

4. The driving method according to claim 1, wherein the address period and the sustain period are differently varied depending on an average picture level (APL).

5. The driving method according to claim 4, wherein if the APL is at a low level, the address period and the sustain period are shortened.

6. The driving method according to claim 4, wherein if the APL is at a high level, the address period and the sustain period are lengthened.

7. The driving method according to claim 1, wherein the frame period is varied by both an address period and a sustain period.

* * * * *